US009723873B2

(12) United States Patent
Liu

(10) Patent No.: US 9,723,873 B2
(45) Date of Patent: Aug. 8, 2017

(54) ELECTRONIC CIGARETTE

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 739 days.

(21) Appl. No.: 13/962,737

(22) Filed: Aug. 8, 2013

(65) Prior Publication Data

US 2014/0332018 A1 Nov. 13, 2014

Related U.S. Application Data

(63) Continuation of application No. PCT/CN2013/075397, filed on May 9, 2013.

(51) Int. Cl.
*A24F 47/00* (2006.01)

(52) U.S. Cl.
CPC ..... *A24F 47/008* (2013.01)

(58) Field of Classification Search
None
See application file for complete search history.

(56) References Cited

U.S. PATENT DOCUMENTS 8,499,766 B1 * 8/2013 Newton ..... A24F 47/008 131/273
2012/0145169 A1 * 6/2012 Wu ..... A24F 47/008 131/273
2012/0312313 A1 * 12/2012 Frija ..... A24F 47/002 131/329
2013/0255702 A1 * 10/2013 Griffith, Jr. ..... A24F 47/008 131/328
2013/0298905 A1 * 11/2013 Levin ..... A24F 47/008 128/202.21
2014/0196718 A1 * 7/2014 Li ..... A61M 11/041 128/202.21

FOREIGN PATENT DOCUMENTS

CN 201894184 U 7/2011
CN 202262413 U 6/2012
CN 102894485 A 1/2013
CN 203121011 U 8/2013

OTHER PUBLICATIONS

International Search Report dated Feb. 6, 2014 for Application No. PCT/CN2013/075397.

* cited by examiner

*Primary Examiner* — Cynthia Szewczyk
(74) *Attorney, Agent, or Firm* — Tim Tingkang Xia, Esq.; Locke Lord LLP

(57) ABSTRACT

An electronic cigarette is provided comprising an atomizer, a battery rod and a connecting component configured to connect the battery rod and the atomizer, one end of the atomizer or the battery rod which is facing towards the connecting component protrudes to form a first connector, and a second connector is provided on the connecting component to be connected with the first connector through sheathing. The electronic cigarette of the present invention can prevent components inside the battery rod or the atomizer exposed to avoid potential risks.

4 Claims, 6 Drawing Sheets

ELECTRONIC CIGARETTE

CROSS-REFERENCE TO RELATED APPLICATIONS

This application is a continuation of International Patent Application No. PCT/CN2013/075397, with an international filing date of May 9, 2013, designating the United States, now pending. The contents of these specifications are incorporated herein by reference.

FIELD OF THE INVENTION

The present invention relates to the field of electrically heating products, and more particularly, relates to an electronic cigarette.

BACKGROUND OF THE INVENTION

In the existing electronic cigarette, a connecting component configured to connect an atomizer and a battery rod and a insertion piece inserted into a protective sleeve of the battery rod or a protective sleeve of the atomizer are integrally formed, and the connecting component engages with the protective sleeve. The insertion piece and the connecting component are integrally formed, when radial bending forces are applied to the electronic cigarette, firstly the insertion piece will disconnect from the protective sleeve of the battery rod or the protective sleeve of the atomizer, then components inside the battery rod or the atomizer will be caused to be exposed, reducing the life of the electronic cigarette, and making it annoying to use and potential risk. As shown in FIG. 1 and FIG. 2, FIG. 1 is a schematic view of the connecting component and the battery rod, or the connecting component and the atomizer in the existing technology. The existing electronic cigarette comprises an atomizer 1, a battery 2 and a connecting component 3 configured to connect the battery rod 2 and the atomizer 1. The atomizer 1 includes a first sleeve barrel 11 and the battery rod 2 includes a second sleeve barrel 21, a first insertion piece 12 and a second insertion piece 22 that are facing towards one end of the connecting component 3 are respectively embedded inside the first sleeve barrel 11 and the second sleeve barrel 21, the connecting component 3 and the first insertion piece 12 are integrally formed, or the connecting component 3 and the second insertion piece 22 are integrally formed.

When the connecting component 3 and the first insertion piece 12 are integrally formed, the connecting component is connected with the second insertion piece 22 through screwing. When the connecting component 3 and the second insertion piece 22 are integrally formed, the connecting component is connected with the first insertion piece 12 through screwing as well. The first insertion piece 12 and the first sleeve barrel 11 are connected by an interference fit, and the second insertion piece 22 and the second sleeve barrel 22 are also connected by an interference fit.

When radial bending forces are applied to the electronic cigarette, the strength of the threaded connection is larger than the connection strength of the first insertion piece 12 and the first sleeve barrel 11, and the connection strength of the second insertion piece 22 and the second sleeve barrel 21, so that the first insertion piece 12 or the second insertion piece 22 will disconnect from the corresponding sleeve barrel, making components inside the atomizer 1 or the battery rod 2 exposed, and causing potential risk.

SUMMARY OF THE INVENTION

The objective of the present invention is to provide an electronic cigarette for avoiding the components inside the battery rod or the atomizer being exposed when radial bending forces are applied to the electronic cigarette, aiming at the above-mentioned drawbacks that the components inside the battery rod or the atomizer may be exposed to lead to potential risks when radial bending forces are applied to the electronic cigarette in the prior art.

An electronic cigarette is provided, which comprises an atomizer, a battery rod and a connecting component configured to connect the battery rod and the atomizer, one end of the atomizer or the battery rod which is facing towards the connecting component protrudes to form a first connector, and a second connector is provided on the connecting component to be connected with the first connector through sheathing.

Advantageously, the connecting component further includes a connecting department having the same axis with the second connector, and an external thread is provided on the connecting department.

Advantageously, the atomizer includes a first sleeve barrel and a first insertion piece embedded inside the first sleeve barrel and facing towards one end of the connecting component; the battery rod includes a second sleeve barrel and a second insertion piece embedded inside the second sleeve barrel and facing towards one end of the connecting component.

Advantageously, the first connector and the first insertion piece are integrally formed; an internal thread is provided on the second insertion piece forms, the connecting department is connected with the second insertion piece through screwing.

Advantageously, the first connector and the second insertion piece are integrally formed; an internal thread is provided on the first insertion piece, the connecting department is connected with the first insertion piece through screwing.

Advantageously, the first connector is a cylinder or a cone whose diameter decreases gradually towards a free end of the first connector, a hole matched with the shape of the first connector is provided on the second connector, the first connector and the second connector are connected by an interference fit.

Advantageously, the second connector is a cylinder or a cone whose diameter decreases gradually towards a free end of the second connector, a hole matched with the shape of the second connector is provided on the first connector, the first connector and the second connector are connected by an interference fit.

Advantageously, the range of the length of a sheathing part both of the first connector and the second connector in the axial direction of the electronic cigarette is within 3 mm~7 mm.

Advantageously, the first insertion piece and the first sleeve barrel are connected by an interference fit; the second insertion piece and the second sleeve barrel are connected by an interference fit.

Advantageously, the depth that the first insertion piece embedded into the first sleeve barrel and that the second insertion piece embedded into the second sleeve barrel is within 5~20 mm respectively.

When implementing the electronic cigarette of the present invention, the following advantageous effects can be achieved: the first connector and the second connector are connected through sheathing, so that the first connector can disconnect from the second connector under radial bending forces. According to the mechanical theory, when the radial bending forces are applied to the electronic cigarette, the first connector will disconnect from the second connector before the first insertion piece connecting with the first sleeve barrel, or before the second insertion piece connecting with the second sleeve barrel, thereby preventing the components inside the atomizer and the battery rod exposed, and ensuring the electronic cigarette to be used more safely.

BRIEF DESCRIPTION OF THE DRAWINGS

The present invention will be further described with reference to the accompanying drawings and embodiments in the following, in the accompanying drawings.

DETAILED DESCRIPTION OF THE PREFERRED EMBODIMENT

To make the technical feature, objective and effect of the present invention be understood more clearly, now the specific implementation of the present invention is described in detail with reference to the accompanying drawings and embodiments.

Figure 1:
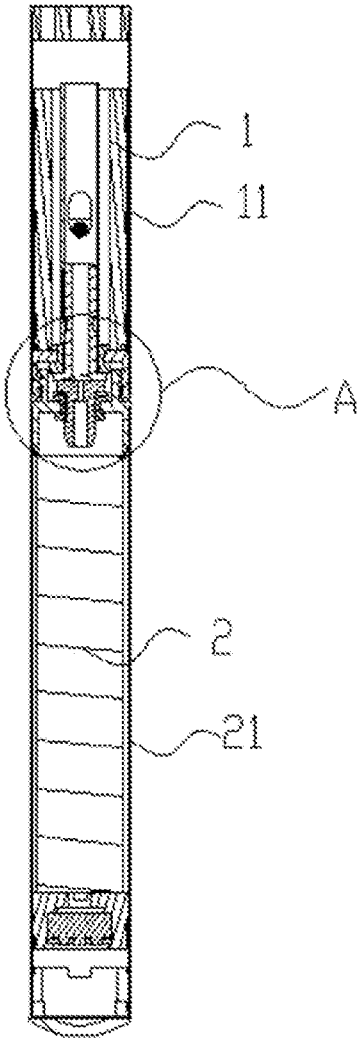
FIG. 1 is a schematic view of the connecting department of the existing electronic cigarette.
Figure 2:
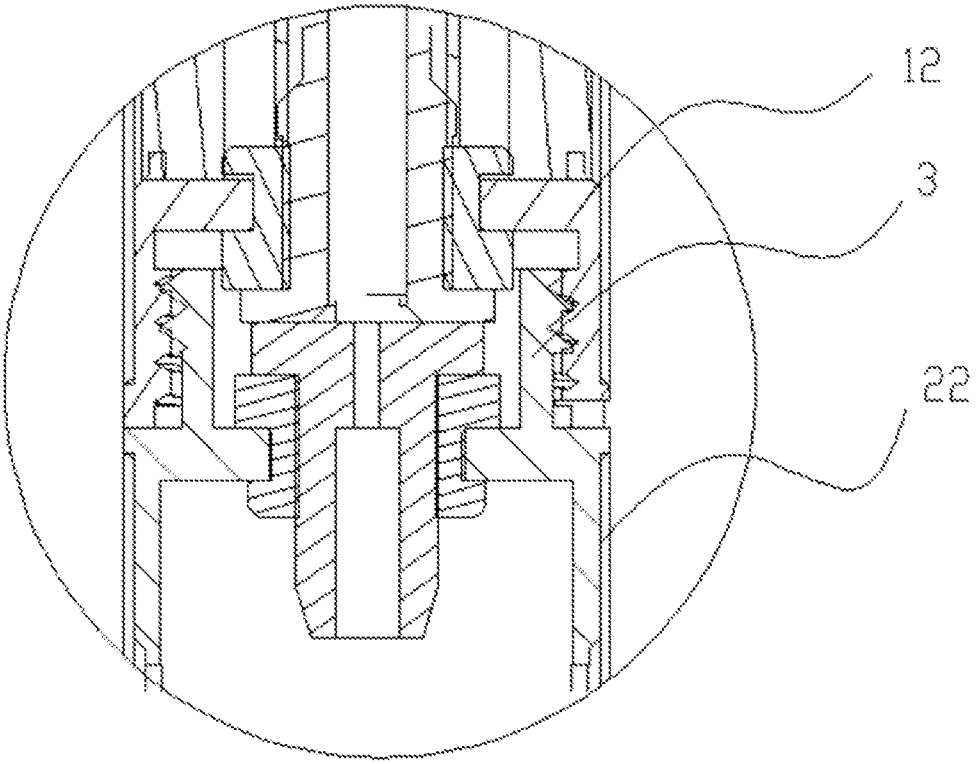
FIG. 2 is an enlarged view of part A in FIG. 1.
Figure 3:
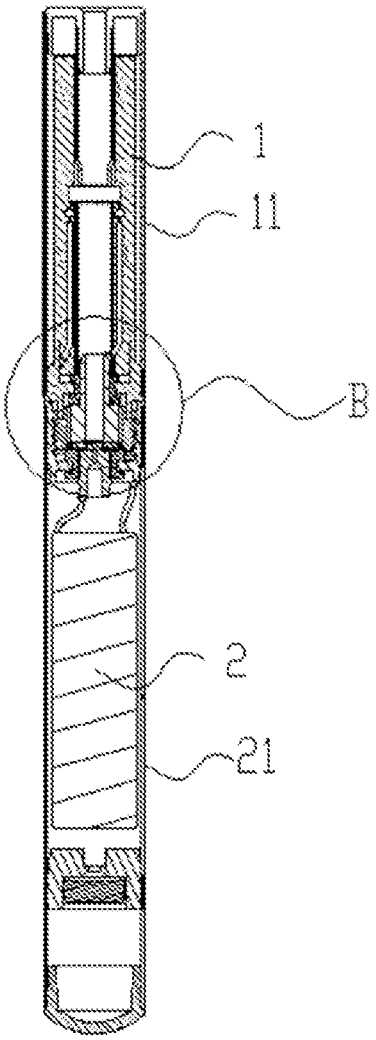
FIG. 3 is a whole schematic view of the electronic cigarette of the present invention.
Figure 4:
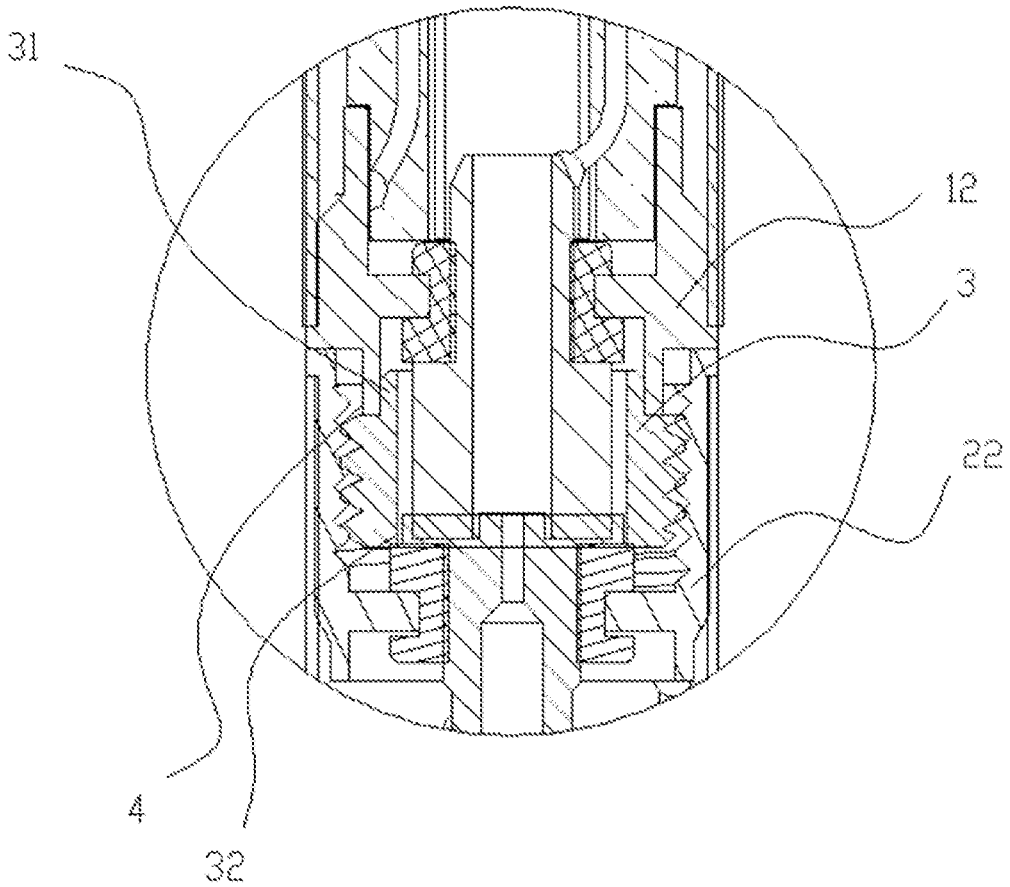
FIG. 4 is an enlarged view of part B in FIG. 3.

As shown in FIG. 3 and FIG. 4, an electronic cigarette is provided, which comprises an atomizer 1, a battery rod 2 and a connecting component 3 configured to connect the battery rod 2 and the atomizer 1, one end of the atomizer 1 or the battery rod 2 which is facing towards the connecting component 3 protrudes to form a first connector 4, and a second connector 31 is provided on the connecting component 3 to be connected with the first connector 4 through sheathing.

The first connector 4 can disconnect from the second connector 31 under radial bending forces as the first connector 4 and the second connector 31 are connected through sheathing.

The connecting component 3 further includes a connecting department 32 having the same axis with the second connector 31, an external thread is provided on the connecting department 32. The atomizer 1 includes a first sleeve barrel 11 and a insertion piece 12 embedded inside the first sleeve barrel 11 and facing towards one end of the connecting component 3, the battery 2 includes a second sleeve barrel 21 and a second insertion piece 22 embedded inside the second sleeve barrel 21 and facing towards one end of the connecting component 3.

The first insertion piece 12 and the first sleeve barrel 11 are connected by an interference fit; the second insertion piece 22 and the second sleeve barrel 21 are connected by an interference fit.

In the present invention, the atomizer 1 and the battery rod 2 can be connected to each other through screwing the first insertion piece 12 or the second insertion piece 22 into the connecting department 32.

When the second insertion piece 22 is screwing into the connecting department 32, namely the first connector 4 and the first insertion piece 12 are integrally formed, an internal thread is provided on the second insertion piece 22, and the connecting department 32 is connected with the second insertion piece 22 through screwing, so that the atomizer 1 and the battery rod 2 are connected.

When the first insertion piece 12 is screwing into the connecting department 32, namely the first connector 4 and the second insertion piece 22 are integrally formed, an internal thread is provided on the first insertion piece 12, and the connecting department 32 is connected with the first insertion piece 12 through screwing, so that the atomizer 1 and the battery rod 2 are connected (FIG. 3, FIG. 4, FIG. 5 and FIG. 6 only show the case that the first connector and the first insertion piece are integrally formed).

It should to be understood that the connecting means between the connecting department 32 and the first insertion piece 12 or between the connecting department 32 and the second insertion piece 22 is not limited to threaded connection, but also can be clamp connection.

Figure 5:
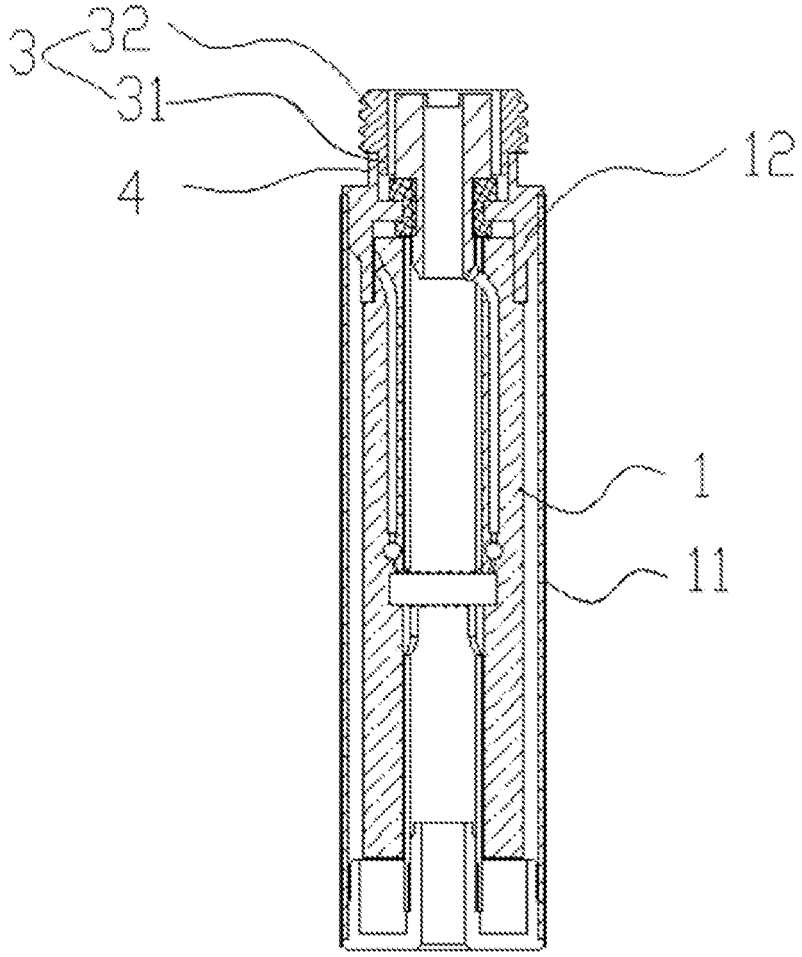
FIG. 5 is a schematic view of the electronic cigarette of the present invention, wherein the first connector and the first insertion piece are integrally formed and the first connector is connected with the second connector through sheathing.
Figure 6:
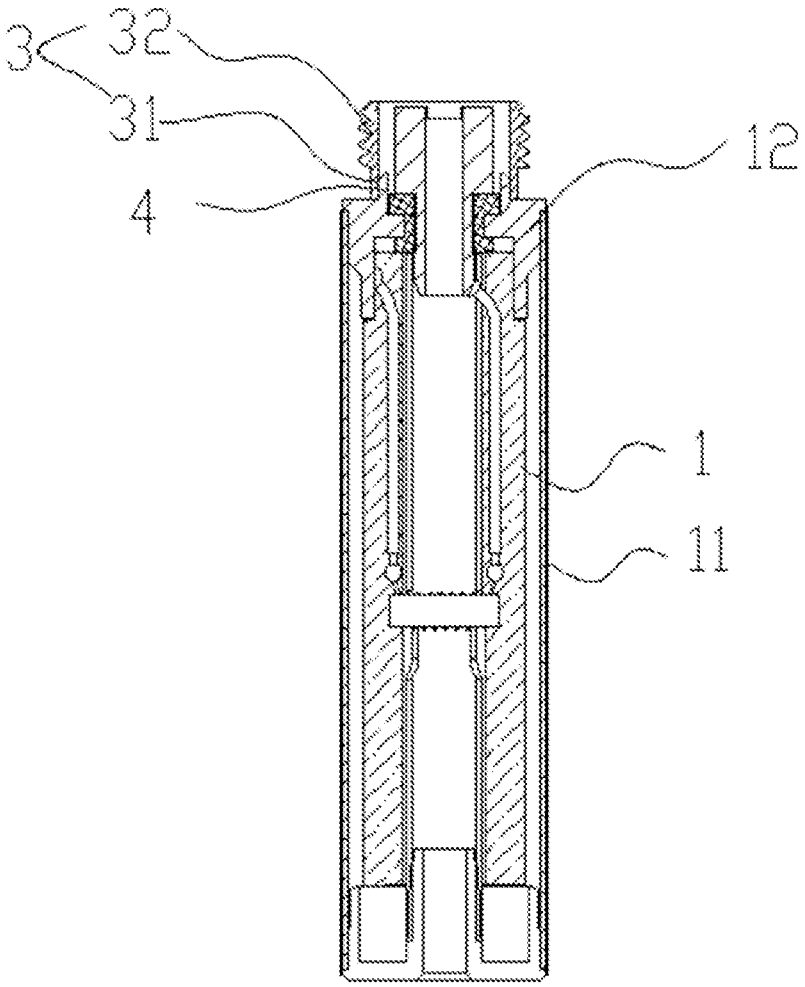
FIG. 6 is a schematic view of the electronic cigarette of the present invention, wherein the first connector and the first insertion piece are integrally formed and the second connector is connected with the first connector through sheathing.

As shown in FIG. 5 and FIG. 6, there are two connection means between the first connector 4 and the second connector 31, one is the first connector 4 sheathing around the second connector 31, and the other is the second connector 31 sheathing around the first connector 4.

When the first connector 4 is sheathed around the second connector 31, the second connector 31 is a cylinder or a cone whose diameter decreases gradually towards a free end of the second connector 31. A hole matched with the shape of the second connector 31 is provided on the first connector 4, the first connector 4 and the second connector 31 are connected by an interference fit (understandably, the free end of the second connector 31 is away from the connecting department 32).

When the second connector 31 is sheathed around the first connector 4, the first connector 4 is a cylinder or a cone (not shown) whose diameter decreases gradually towards a free end of the first connector 4. A hole matched with the shape of the first connector 4 is provided on the second connector 31, the first connector 4 and the second connector 31 are connected by an interference fit (understandably, the free end of the second connector 31 is facing towards the connecting department 32).

Similarly, analyzing from the angle of mechanics, when radial bending forces are applied to the electronic cigarette, the electronic cigarette will break at the abutted surface of the first insertion piece 12 or the second insertion piece 22, but not at the junction of the first insertion piece 12 or the second insertion piece 22 which is connected to their respective sleeve barrel. Understandably, when the electronic cigarette breaks at the abutted surface of the first insertion piece 12 or the second insertion piece 22, because the connecting department 32 is connected with the first insertion piece 12 or the second insertion piece 22 by threaded connection or clamp connection, the connecting strength is larger than that of the interference fit between the first connector 4 and the second connector 31, the first connector 4 can disconnect from the second connector 31 firstly.

Specifically, the range of the length of a sheathing part both of the first connector 4 and the second connector 31 in the axial direction of the electronic cigarette is within 3 mm~7 mm. Understandably, if the length of the sheathing part both of the first connector 4 and the second connector 31 in the axial direction is too small, the first connector 4 can disconnect from the second connector 31 under a smaller bending force, which may be inconvenient. If the length of the sheathing part both of the first connector 4 and the second connector 31 in the axial direction is too large, when under a larger bending force, although breaking at the junction between the first insertion piece 12 and the second insertion piece 22 firstly, the first connector 4 can not disconnect from the second connector 31 furthermore, but the first insertion piece 12 or the second insertion piece 22 will disconnect from its respective sleeve barrel firstly, making components inside the atomizer 1 or the battery rod 2 exposed, and causing potential risk; even if the first connector 4 or the second connector 31 is disconnected firstly, the first connector 4 or the second connector 31 may be damaged due to excessive length of the sheathing part.

Preferably, the depth that the first insertion piece 12 embedded into the first sleeve barrel 11 and that the second insertion piece 22 embedded into the second sleeve barrel 21 is within 5~20 mm respectively. So the first connector 4 can disconnect from the second connector 31 prior to the first insertion piece 12 disconnecting from the first sleeve barrel 11 or the second insertion piece 22 disconnecting from the second sleeve barrel 21, and can help prevent the cost and the volume increased due to the excessive length of the insertion piece.

While the embodiments of the present invention are described with reference to the accompanying drawings above, the present invention is not limited to the above-mentioned specific implementations. In fact, the above-mentioned specific implementations are intended to be exemplary not to be limiting. In the inspiration of the present invention, those ordinary skills in the art can also make many modifications without breaking away from the subject of the present invention and the protection scope of the claims. All these modifications belong to the protection of the present invention.

What is claimed is:

1. An electronic cigarette comprising an atomizer, a battery rod and a connecting component configured to connect the battery rod and the atomizer;

wherein one end of the atomizer or the battery rod which is facing towards the connecting component protrudes to form a first connector, and a second connector is provided on the connecting component to be connected with the first connector through sheathing;

wherein the connecting component further includes a connecting department having the same axis with the second connector, and an external thread is provided on the connecting department;

wherein the atomizer includes a first sleeve barrel and a first insertion piece embedded inside the first sleeve barrel and facing towards one end of the connecting component; the battery rod includes a second sleeve barrel and a second insertion piece embedded inside the second sleeve barrel and facing towards one end of the connecting component;

wherein the first connector and the first insertion piece are integrally formed or the first connector and the second insertion piece are integrally formed;

when the first connector and the first insertion piece are integrally formed, an internal thread is provided on the second insertion piece, the connecting department is connected with the second insertion piece through screwing;

when the first connector and the second insertion piece are integrally formed, an internal thread is provided on the first insertion piece, the connecting department is connected with the first insertion piece through screwing;

wherein a range of a length of a sheathing part of both the first connector and the second connector in an axial direction of the electronic cigarette is within 3 mm to 7 mm;

wherein a depth that the first insertion piece embedded into the first sleeve barrel and that the second insertion piece embedded into the second sleeve barrel is within 5 to 20 mm respectively; and wherein the connecting department is connected with the first insertion piece or the second insertion piece by a threaded connection, the first connector and the second connector are connected by an interference fit.

2. The electronic cigarette of claim 1, wherein the first connector is a cylinder or a cone whose diameter decreases gradually towards a free end of the first connector, a hole matched with the shape of the first connector is provided on the second connector, the first connector and the second connector are connected by an interference fit.

3. The electronic cigarette of claim 1, wherein the second connector is a cylinder or a cone whose diameter decreases gradually towards a free end of the second connector, a hole matched with the shape of the second connector is provided on the first connector, the first connector and the second connector are connected by an interference fit.

4. The electronic cigarette of claim 1, wherein the first insertion piece and the first sleeve barrel are connected by an interference fit; the second insertion piece and the second sleeve barrel are connected by an interference fit.

* * * * *